United States Patent [19]

Vancheri et al.

[11] Patent Number: 4,464,129

[45] Date of Patent: Aug. 7, 1984

[54] SAFETY MARKER FOR DIVERS

[75] Inventors: Patrice Vancheri; Henri Lefebvre, both of Castres, France

[73] Assignee: Societe Syselec (S.A.R.L.), Puylaurens, France

[21] Appl. No.: 326,377

[22] Filed: Dec. 1, 1981

[30] Foreign Application Priority Data

Dec. 1, 1980 [FR] France ..... 80 25517

[51] Int. Cl.[3] ..... B63B 45/00

[52] U.S. Cl. ..... 441/16; 441/13; 340/984; 116/107; 116/26

[58] Field of Search ..... 441/6, 11, 12, 13, 16, 441/32, 36, 89; 116/26, 107, 108, 202; 340/29, 566; 405/185, 186; 367/3, 4, 5

[56] References Cited

U.S. PATENT DOCUMENTS

| | | | |
|---|---|---|---|
| 1,158,967 | 11/1915 | Bellingham | 340/29 |
| 1,181,791 | 5/1916 | Nord | 405/185 |
| 1,374,943 | 4/1921 | Melvin | 441/11 |
| 1,669,055 | 5/1928 | Hogg | 441/16 |
| 2,397,844 | 4/1946 | Dewhurst | 367/3 |
| 2,448,787 | 9/1948 | Ferrel | 340/566 |
| 3,588,803 | 6/1971 | Fleming, Jr. et al. | 340/566 |
| 3,833,955 | 9/1974 | Hulbert, Jr. | 441/16 |
| 4,099,168 | 7/1978 | Kedjierski et al. | 340/566 |

FOREIGN PATENT DOCUMENTS

| | | | |
|---|---|---|---|
| 1482763 | 4/1967 | France . | |
| 2248974 | 5/1975 | France . | |
| 55-152483 | 11/1980 | Japan | 441/13 |

*Primary Examiner*—Galen L. Barefoot
*Assistant Examiner*—Rodney Corl
*Attorney, Agent, or Firm*—Shlesinger, Arkwright, Garvey & Fado

[57] ABSTRACT

A safety marker for divers comprising detection means (5) designed to emit electrical signals upon the appearance of an element dangerous to the divers within a specific zone around said marker, means (8) for shaping these signals to control signalling means (6, 7) arranged on one hand at the surface to signal the presence of divers and on the other hand below surface to signal the presence of a danger to the divers.

3 Claims, 7 Drawing Figures

SAFETY MARKER FOR DIVERS

The present invention concerns a safety marker for divers. Sea-diving has much grown in recent years and draws increasingly more devotees. However there is also an increasing number of yearly accidents because when the diver goes up to the surface, he is ignorant of any danger, for instance from a propeller boat, while at the surface, there is no signal indicating the presence of a diver.

While signalling markers are know which are topped by a flag on a buoy, these are not easily seen in clear weather and invisible in low visibility or at night.

Again there are distress beacons comprising a floating body topped by an electronic light such as described in French Pat. No. 2,248,974. Such a beacon is useful to locate the shipwrecked but does not notify a diver that rising to the surface is dangerous.

Again an apparatus is known comprising a beacon to signal at the surface the position of a diver, said apparatus being described in the French Pat. No. 1,482,763 and comprising an anchor-releasing means and displaying a distress signal; while this apparatus allows the diver to signal he is in trouble, it does not allow him to know there is danger at the surface.

The object of the present invention is to remedy these drawbacks and to provide a safety marker which signals both at the surface the presence of divers and below the surface to the divers there is a danger when rising to the surface.

Another object of the present invention is to provide a simple, effective and economical safety marker for divers.

An essential characteristic of the safety marker of the invention is that it includes:

- detection means to emit electric signals upon the entry of a dangerous element into a specific zone around the said marker.
- shaping means for these signals to control signalling means, and
- means signalling the presence of divers and the appearance of a dangerous element in said specific zone around said marker.

Another essential characteristic of the invention consists in arranging the signalling means on one hand below the surface of the water to signal the presence of the danger to the divers and on the other hand at the surface to signal the presence of divers.

Other features of the safety marker of the present invention will be described below in connection with the attached drawing which is provided in illustrative and non-restricting manner.

Figure 1:
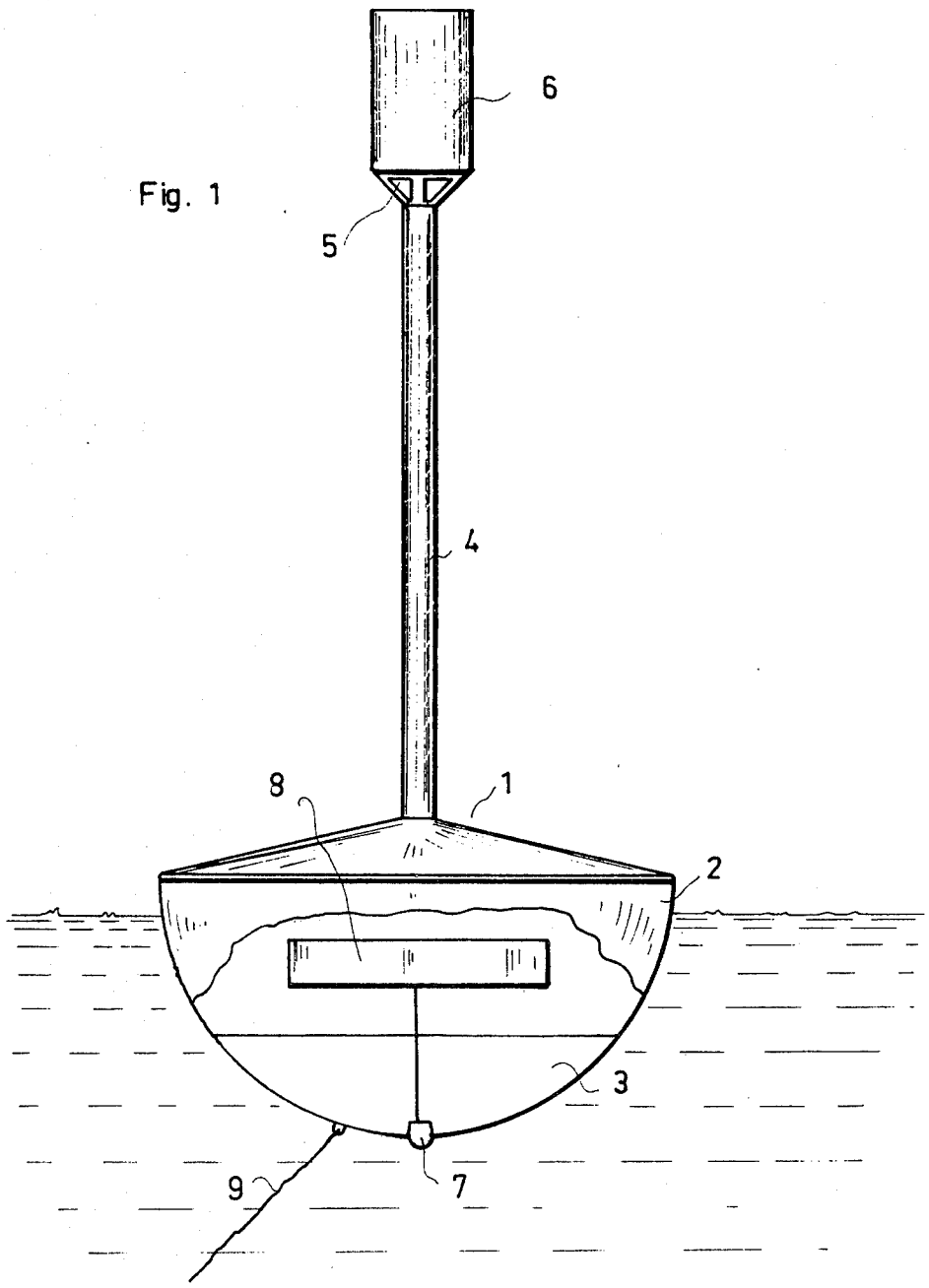
FIG. 1 is an overall view of the safety marker of the invention.

FIG. 1 shows a marker consisting of a floating body 1 consisting in manner known per se of a water-tight air-tank 2 comprising a ballast 3. This floating body is topped by a mast 4 at the tip of which are arranged detection means 5 and signalling means 6. Second signalling means 7 are arranged underneath the floating body 1. The electronic control 8 for the signalling means 6 and 7 is located within the water-tight air-tank 2. Lastly, a cable 9 allows linking the marker either to an anchor (omitted) or to the diver's body. In the latter case, a winding drum (omitted) can be arranged within the floating body 1 to permit the marker to follow the diver without hampering his motion.

The safety marker of the invention operates as follows: when a danger to the diver, for instance a propeller boat, is cruising near the diving site, the detectors 5 sense this danger and emit electric signals into the electronic circuit 8, where said signals after shaping will control the signalling means 6 and 7. The signalling means 6 alert the boat's crew it is a danger to the divers and should pass at a distance, and the signalling means 7 alert the divers of the presence of the boat at the surface, hence that rising to the surface is dangerous.

In the preferred embodiment of the present invention, the detectors 5 are acoustic, for instance consisting of one or several microphones 10 for the purpose of detecting the noise from the engines of boeats cruising in the vicinity, the signalling means 6 are luminous, for instance consisting of one or several electronic flashing lamps 11, and the signalling means 7 also are luminous, for instance consisting of an incandescent lamp 12.

Figure 3:
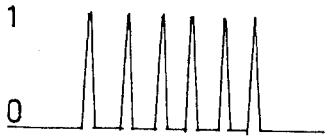
FIGS. 3–3*d* are summary plot of the signal shape at the output of each stage of the control circuit of the safety marker of the present invention.
Figure 3A:
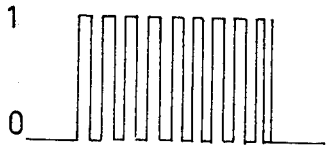
Figure 3B:
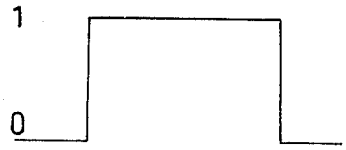
Figure 3C:
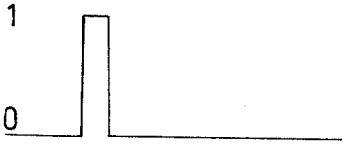
Figure 3D:
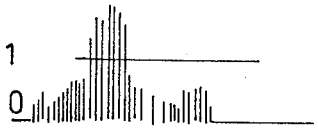
Figure 2:
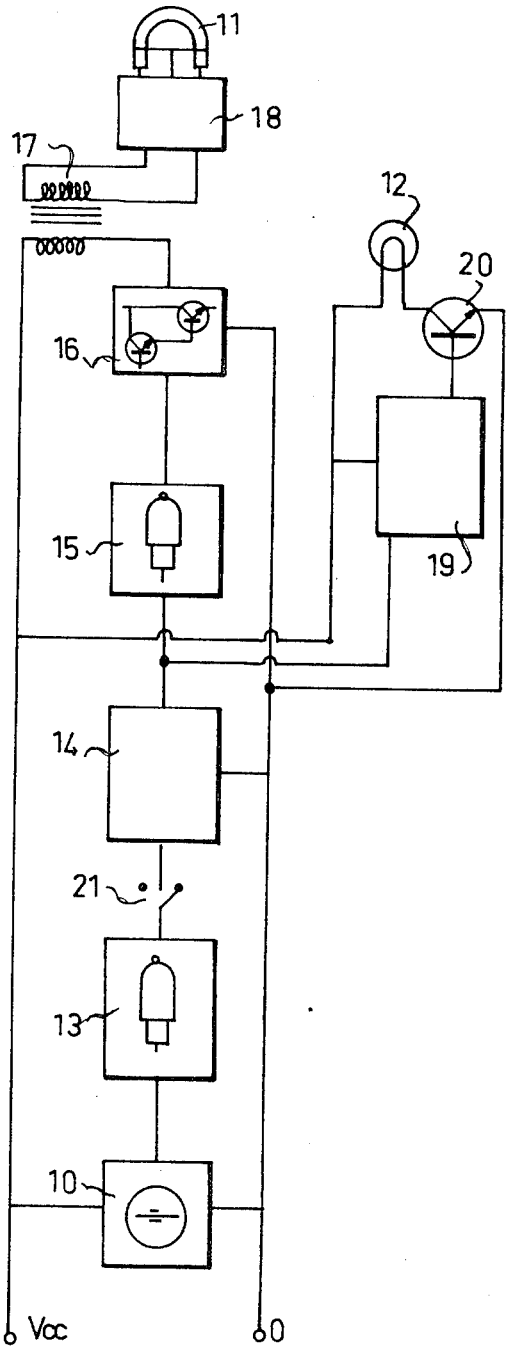
FIG. 2 is a diagram of the electronic circuit for the safety marker of the present invention.

The electronic control circuit 8 (FIGS. 2 and 3) includes an amplifier 13 designed to receive the microphone 10 signals and to transmit at a given level a trigger pulse to a resetting monostable flip-flop 14. This flip-flop emits a time-delayed DC signal to a low-voltage oscillator 15 which transforms the DC signal into an AC control signal for a Darlington circuit 16. A transformer 17 then is fed in step with the oscillations. The secondary of the transformer 17 emits high voltage signals into and oscillator 18 feeding the flasing lamp 11. The monostable flip-flop 14 also emits control signals into a circuit 19 feeding through a transistor 20 the lamp 12. A switch 21 permits shorting the microphone 10 and the amplifier 13 for the purpose of DC operation of the lamps 11 and 12.

It is manifest that the above description of the preferred embodiment of the invention was provided in purely illustrative and non-limiting manner. Thus the detection means 5 might be ultrasonic, for instance a radar system, or optical, for instance an infrared system. Similarly, the signalling means 6 might be acoustic, for nstance a siren, or ultra-acoustic, for instance a radio emitter. These means, or a combination of them ensure the effectiveness of the safety marker of the invention regardless of visibility or atmospheric conditions. They also make it possible to detect a greater variety of dangers.

Lastly, other modifications may be introduced because the invention is not restricted to the description provided above but on the contrary includes all variations.

We claim:

1. A water safety marker for divers, comprising:

(a) a float having a top and a bottom and a water line;

(b) a mast having a top mounted on said top of said float projecting a substantial distance above said top of said float and above said water line;

(c) ballast in said bottom of said float for maintaining said float upright in said water and positioned below said water line;

(d) light signaling means mounted on said mast top for signaling to a surfaced object;

(e) a float light signaling means for signaling to said divers mounted in said float and having at least a portion extending below said ballast and substantially below said water line;

(f) electronic detection means mounted on said top of said mast and below said light signaling means for generating a signal when the presence of the approach of said surface object is detested;

(g) means for shaping said signal positioned in said float; and, (h) control means associated with said signal shaping means for intermittent operation of both said mast top light signaling means and said float light signaling means when detection of a surface object occurs.

2. The marker defined in claim 1, wherein:

(a) said signal shaping means is disposed below said water line and above said ballast.

3. The marker defined in claim 1, wherein:

(a) said electronic detection means includes a microphone.

* * * * *